US005458511A

United States Patent [19]

Sasai et al.

[11] Patent Number: 5,458,511

[45] Date of Patent: Oct. 17, 1995

[54] CONNECTOR WITH DOUBLE-LOCK CONSTRUCTION

[75] Inventors: Osamu Sasai; Masaji Suzuki, both of Yokkaichi, Japan

[73] Assignee: Sumitomo Wiring Systems, Ltd., Mie, Japan

[21] Appl. No.: 121,541

[22] Filed: Sep. 16, 1993

[30] Foreign Application Priority Data

Oct. 7, 1992 [JP] Japan ..... 4-076440 U

[51] Int. Cl.[6] ..... H01R 13/436

[52] U.S. Cl. ..... 439/752; 439/595; 403/326

[58] Field of Search ..... 439/752, 595; 403/321, 322, 326, 328

[56] References Cited

U.S. PATENT DOCUMENTS

| | | | |
|---|---|---|---|
| 4,583,805 | 4/1986 | Mantlik . | |
| 5,108,319 | 4/1992 | Tsuji et al. | 439/752 |
| 5,240,433 | 8/1993 | Kato | 439/752 |
| 5,244,421 | 9/1993 | Jinno et al. | 439/752 |
| 5,292,261 | 3/1994 | Hirano et al. | 439/752 |
| 5,322,456 | 6/1994 | Yagi et al. | 439/752 |

FOREIGN PATENT DOCUMENTS 1-43986 9/1989 Japan .

*Primary Examiner*—Richard A. Bertsch
*Assistant Examiner*—William Wicker
*Attorney, Agent, or Firm*—Oliff & Berridge

[57] ABSTRACT

A housing has guide holes that have stair-like surfaces constituted by horizontal wall surfaces and slanting surfaces that are continuously connected together. A retainer has guide pieces that have horizontal wall surfaces and a slanting surface that are continuously connected together. When the guide pieces are inserted into the guide holes, respectively, the slanting surfaces are abutted against each other to achieve a provisionally-locked condition. Thereafter, when the retainer is pushed forwardly, the guide piece moves obliquely in the guide hole along their slanting surfaces, and therefore moves downward and forward to reach a completely-locked position.

10 Claims, 5 Drawing Sheets

CONNECTOR WITH DOUBLE-LOCK CONSTRUCTION

BACKGROUND OF THE INVENTION

This invention relates to a connector, and more particularly to a connector of a double-lock construction.

FIGS. 9 and 10 show a conventional connector of this type. FIG. 9 shows a condition in which a retainer (terminal retainer) 1 is provisionally locked relative to a housing 2, and FIG. 10 shows a completely-locked condition.

The housing 2 has terminal receiving chambers 3, and a metal terminal 5 having an electric wire 4 clamped thereto can be inserted into the terminal receiving chamber 3 from a rear end opening 3*a* thereof. The retainer 1 has a cap-shape for covering a rear end portion 2*a* of the housing 2. As the rear end portion 2*a* is inserted into the retainer, the housing is provisionally locked immediately before it abuts against a rear end surface. When the rear end portion is further inserted, it abuts against the rear end surface, so that the housing is completely locked. Insertion holes 1*a* generally equal in shape to the rear end opening 3*a* are formed in the rear end face of the retainer 1, and a terminal retaining piece $1a_1$ extends from an upper edge of the insertion hole 1*a* toward the housing 2.

In the provisionally-locked condition, a lower inner surface 1*b* of the retainer 1 is held in contact with a lower outer surface 2*b* of the rear end portion of the housing 2, and each insertion hole 1*a* in the retainer 1 faces the corresponding rear end opening 3*a* of the housing 2, and the terminal retaining piece $1a_1$ faces the upper edge of the rear end opening 3*a*.

In this condition, as the metal terminal 5 having the wire 4 clamped thereto is inserted in the rear end opening 3*a* through the insertion hole 1*a* of the retainer 1, a retaining piece 5*a* formed on the upper surface of the metal terminal 5 is engaged with a terminal retaining pawl 3*b* provided within the terminal receiving chamber 3, thereby achieving a first withdrawal preventing connection. At this time, the terminal retaining piece $1a_1$ is disposed in facing relation to the upper edge of the rear end opening 3*a* and therefore will not obstruct the insertion of the metal terminal 5.

After the metal terminal 5 is inserted, the retainer 1 is pressed down in a direction indicated by arrow A (FIG. 10) so that the terminal retaining piece $1a_1$can be inserted into the rear end opening 3*a*. The retainer is then pushed in a direction indicated by arrow B. As a result, the terminal retaining piece $1a_1$ moves along an upper portion of the inner surface of the rear end opening 3*a* and is received in the terminal receiving chamber 3, and the distal end surface of this terminal retaining piece abuts against an upper portion of a rear end of an insulation barrel 5*b* of the metal terminal 5 from the rear side, thereby achieving a second withdrawal preventing connection.

Since the two-step motion, that is, the pressing-down and the subsequent pushing-forward, is needed, the operativity is poor, and the arrangement is not suitable for automation.

Referring to another construction shown in FIGS. 11 and 12, FIG. 11 shows a condition in which a retainer is provisionally locked relative to a housing 2, and FIG. 12 shows a completely-locked condition.

Retaining pieces 1*c*, insertable respectively into terminal receiving chambers, are formed on the retainer 1 in a projected manner. A space 3*c* for allowing the retaining piece 1*c* to stand by therein is provided in an upper portion of the terminal receiving chamber 3 at a rear end portion thereof. When the retainer 1 is pushed forward after a metal terminal 5 is inserted into the terminal receiving chamber 3, the retaining piece 1*c* abuts against a slanting surface 2*c*, formed on the housing 2 and disposed forwardly of the space 3*c*, to be flexed downwardly, and further advances to abut against an upper portion 5*c* of a rear end of a contact portion of the metal terminal 5.

This connector has a problem in that since the retaining piece 1*c* is flexed as the retainer is pushed forward, the force required for this pushing operation increases with the increase of the number of terminal receiving chambers 3. Another problem is that after a lapse of a long time, even when the retainer is moved to the provisionally-locked position, the retaining piece 1*c* remains flexed downwardly, so that the metal terminal 5 cannot be withdrawn.

SUMMARY OF THE INVENTION

The present invention has been made in view of the above problems, and an object of the invention is to provide a connector of the type that enables an easy retaining operation, is suited for automation, and does not require a large force.

To achieve the above object, according to the invention, there is provided a connector including a housing having a terminal receiving chamber for holding a metal terminal therein; and a terminal retainer for preventing withdrawal of the metal terminal in a completely-locked position where the terminal retainer is held generally in contact with a rear end of the housing, the terminal retainer allowing easy attachment and detachment of the metal terminal in a provisionally-locked position where the terminal retainer is disposed rearwardly of the rear end, and is spaced slightly radially from an axis of the metal terminal; wherein the housing and the terminal retainer have guide members for guiding the terminal retainer to move obliquely from the provisionally-locked position to the completely-locked position when the terminal retainer is pushed into the housing.

Furthermore, there is provided a connector in which the terminal retainer has a retaining piece projecting along a direction of insertion of the metal terminal; the terminal receiving chamber of the housing has a stand-by portion for allowing the retaining piece to move toward the axis of the metal terminal to prevent withdrawal of the metal terminal, the stand-by portion also allowing, in the provisionally-locked condition, the retaining piece to stand-by at a position spaced from the axis of the metal terminal to thereby prevent the attachment and detachment of the metal terminal from being obstructed.

According to the invention, when the terminal retainer is pushed into the housing, the terminal retainer is moved obliquely by the guide members provided on the terminal retainer and the housing, so that the terminal retainer shifts from the provisionally-locked position to the completely-locked position. The two-step motion is completed by the pushing in one direction.

Furthermore, when the terminal retainer is to be shifted from the provisionally-locked position to the completely-locked position, the retaining piece advances forwardly obliquely toward the metal terminal in the stand-by portion, so that it abuts against part of the metal terminal from the rear side. Therefore, the retaining piece retains the metal terminal without undergoing any forcible deformation.

As described above, in the present invention, the operation is completed by the pushing in one direction, and at this time the terminal retainer advances forwardly toward the metal terminal from the position away from the metal terminal to achieve the withdrawal preventing connection. Therefore, there can be provided a connector in which any forcible flexing of the members does not occur, and the operation can be completed with a small force.

Furthermore, in the invention, the retaining piece moves in the terminal receiving chamber to achieve the withdrawal preventing connection, without undergoing flexing, and therefore the retaining piece will not be continuously being flexed. When the terminal retainer needs to be withdrawn because of maintenance, the retaining piece can get out of the path of movement of the metal terminal by returning the terminal retainer to the provisionally-locked position, and therefore the withdrawal operation can be carried out easily.

DETAILED DESCRIPTION OF PREFERRED EMBODIMENTS

A preferred embodiment of the present invention will now be described with reference to the drawings.

Figure 1:
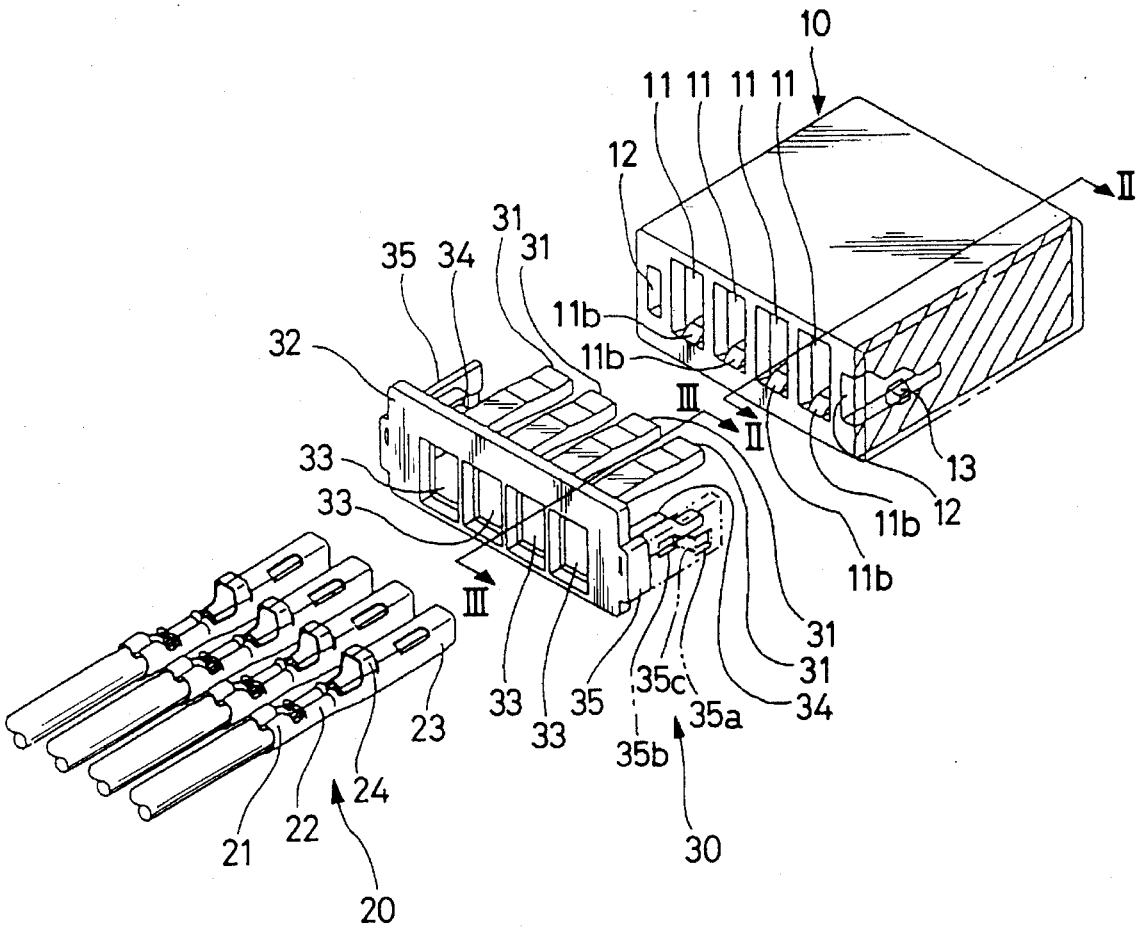
FIG. 1 is a perspective view of a preferred embodiment of the present invention.

FIG. 1 is a perspective view of a preferred embodiment of a connector of the present invention.

Figure 2:
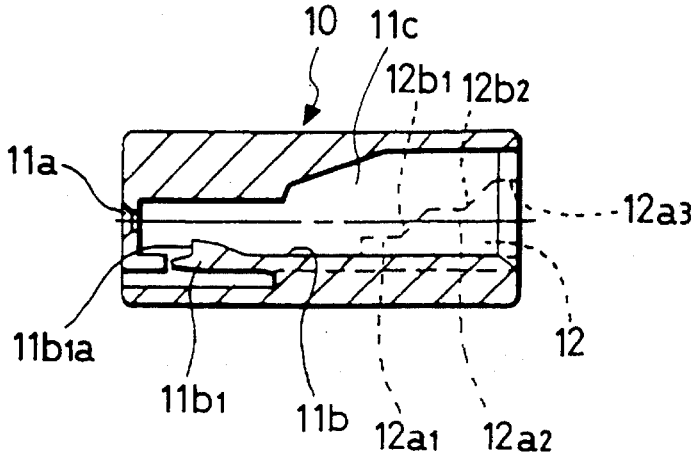
FIG. 2 is a cross-sectional view of a housing.
Figure 3:
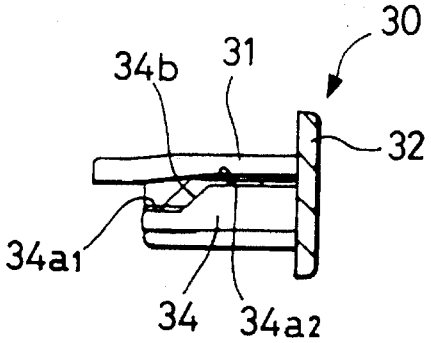
FIG. 3 is a cross-sectional view of a retainer.
Figure 4:
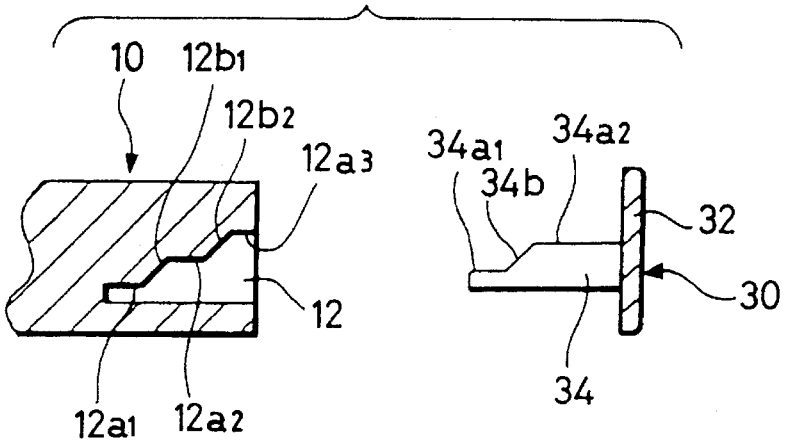
FIG. 4 is a schematic view showing the configuration of a guide hole and a guide piece.

In this figure, a housing 10 has four terminal receiving chambers 11 juxtaposed in a row, and guide holes 12 formed at opposite end portions of the housing, respectively. Each terminal receiving chamber 11 has a cross-sectional shape as shown in FIG. 2, and a small hole 11*a* for the insertion of a male metal terminal therethrough is provided at a front side of the terminal receiving chamber. A ridge-like protuberance 11*b* generally equal in length to the terminal receiving chamber 11 is provided in the terminal receiving chamber 11 and is disposed centrally of the width of the terminal receiving chamber. A notch is formed in the housing 10 at a front end portion of the protuberance 11*b* to provide an engagement arm $\mathbf{11}b_1$, which can be flexed upward and downward. An engagement projection $\mathbf{11}b_{1a}$, which projects upwardly, is formed on an upper surface of the engagement arm $\mathbf{11}b_1$ at the front end portion thereof. An upper wall of a rear portion of the terminal receiving chamber 11 has a height sufficiently greater than the maximum thickness of a metal terminal 20, and this portion forms a stand-by portion 11*c* for a retaining piece 31 of a retainer 30 (described later).

The guide hole 12 has a cross-sectional shape as shown in broken lines in FIG. 2 and a stair-like surface constituted by horizontal wall surfaces $\mathbf{12}a_1$ to $\mathbf{12}a_3$ and slanting surfaces $\mathbf{12}b_1$ and $\mathbf{12}b_2$, which are disposed alternately and continuously connected together. Projections 13 for engagement with the retainer 30 are formed respectively on the opposite side surfaces of the housing 10.

The retainer 30 includes a body 32 generally equal in shape and size to the rear end face of the housing 10, and four insertion holes 33 corresponding respectively to the terminal receiving chambers 11 of the housing 10 are formed in the body 32 and are juxtaposed in a row. Retaining pieces 31 and guide pieces 34 are formed on and projected from one side of the body 32. The retaining piece 31 is projected from the upper side of the insertion hole 33 and has such a width as to be inserted into the stand-by portion 11*c* of the terminal receiving chamber 11. A distal end portion of the retaining piece 31 is slightly curved downwardly.

The two guide pieces 34 correspond respectively to the guide holes 12 formed in the housing 10, and an upper surface of the distal end portion of the guide piece 34 has a stair-like configuration corresponding to that of the guide hole 12 and is constituted by horizontal wall surfaces $\mathbf{34}a_1$ and $\mathbf{34}a_2$ and a slanting surface $\mathbf{34}b_1$, which are continuous with one another. Engagement pieces 35 are formed respectively on the opposite ends of the body 32 and project in the same direction as the direction of projection of the retaining pieces 31 and the guide pieces 34. Two engagement holes 35*a* and 35*b* for coacting with the projection 13 on the side surface of the housing 10 are formed in the engagement piece 35. The engagement holes 35*a* hold the retainer 30 in a provisionally-locked position, and the engagement holes 35*b* hold the retainer in a completely-locked position.

Provided at a rear portion of the metal terminal 20 is an insulation barrel 21 that clamps a sheath of an electric wire, and a conductor of the wire is clamped by a wire barrel of the metal terminal 20. Provided at a front portion of the metal terminal is a tubular contact portion 23 into which the male metal terminal can be inserted. A terminal retaining portion 24 is formed in an upwardly-projecting manner on the metal terminal and is disposed rearwardly of the contact portion 23. Although not shown in the drawings, an engagement hole into which the engagement projection $\mathbf{11}b_{1a}$ can be inserted is formed in a lower surface of the contact portion 23.

Next, the manner of using this embodiment of the above construction will now be described.

Figure 5:
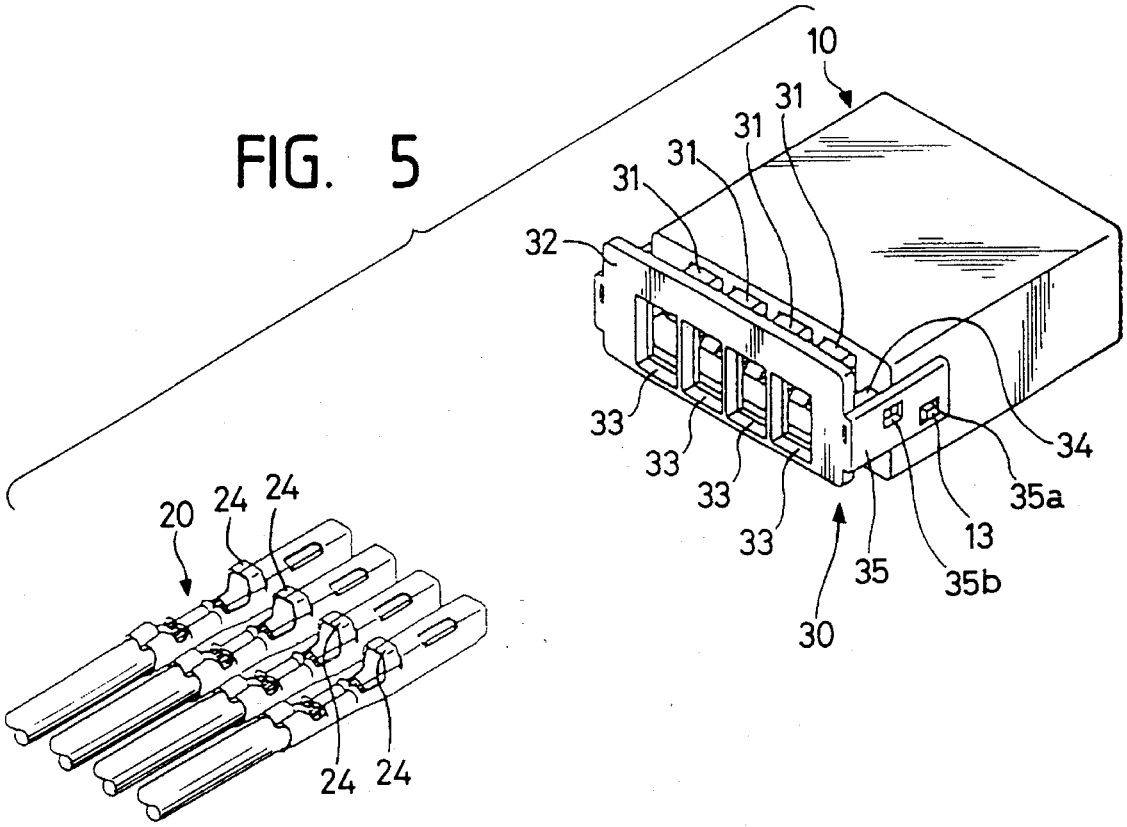
FIG. 5 is a perspective view showing a provisionally-locked condition of the connector.

First, as shown in FIG. 1, the retainer 30 is placed rearwardly of the housing 10, and the retaining pieces 31 of the retainer 30 are inserted respectively into the terminal receiving chambers 11 of the housing 10, and at the same time the guide pieces 34 on the opposite sides of these retaining pieces are inserted respectively into the guide holes 12. At this time, the retaining piece 31 first enters the terminal receiving chamber 11, and advances slightly, and the guide piece 34 enters the guide hole 12. At the same time, the engagement pieces 35 begin to hold the housing 10 at the opposite side surfaces thereof. When the retainer is further advanced, the projection 13 on the housing 10 becomes received in the front hole 35*a* in the engagement piece 35 as shown in FIG. 5, and therefore the housing 10 and the retainer 30 are thus engaged with each other at this position in such a manner that the two will not be displaced with respect to each other.

Figure 6:
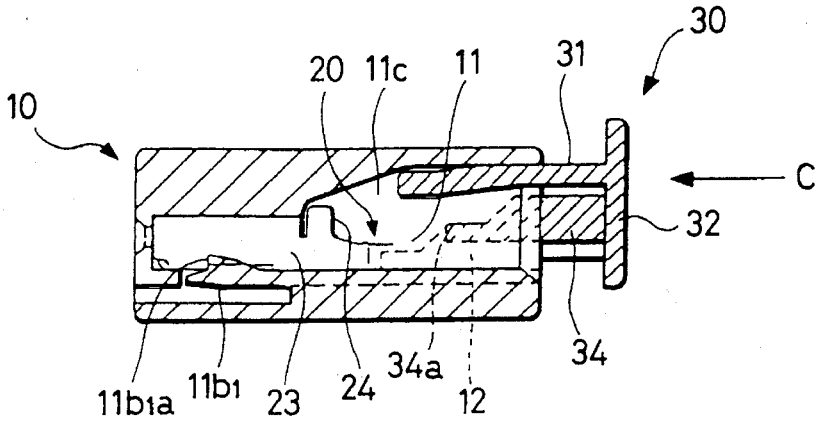
FIG. 6 is a cross-sectional view of the connector in the provisionally-locked condition.

At this time, as shown in FIG. 6, the front horizontal wall surface $34a_1$ of the guide piece 34 is held in contact with the intermediate horizontal wall surface $12a_2$ of the guide hole 12, and the rear horizontal wall surface $34a_2$ of the guide piece 34 is held in contact with the horizontal wall surface $12a_3$ of the guide hole 12 disposed adjacent the open end. The slanting surface 34*b* of the guide piece 34 is held in contact with the slanting surface $12b_2$ of the guide hole 12 disposed adjacent the open end. Therefore, the two will not move relative to each other, and they are held together in the provisionally-retained position. The retaining piece 31 is held adjacent the upper wall surface of the stand-by portion 11*c* of the terminal receiving chamber 11, and the open end of each terminal receiving chamber 11 is generally aligned with and faces the mating insertion hole 33 of the retainer 30.

As the metal terminal 20 is inserted into the terminal receiving chamber 11 through the insertion hole 33 of the retainer 30, the metal terminal 20 advances in sliding contact with the upper surface of the protuberance 11*b*. Then, the lower edge of the front end of the metal terminal abuts against the engagement projection $11b_{1a}$, formed on the engagement arm $11b_1$, to flex the engagement arm $11b_1$ downwardly. When the metal terminal is further advanced to abut at its front end against the inner surface of the terminal receiving chamber 11 at the front end thereof, the engagement projection $11b_{1a}$ faces the engagement hole formed in the lower surface of the contact portion 23, and this engagement projection $11b_{1a}$ is inserted into this engagement hole by the restoring force of the engagement arm $11b_1$, thereby achieving a first withdrawal preventing connection by this engagement between the two.

During the time when the metal terminal 20 is thus inserted into the terminal receiving chamber 11, the retaining piece 31 is held adjacent the upper wall surface of the stand-by portion 11*c* and therefore does not obstruct this insertion, and furthermore, the retaining piece 31 is not flexed by contact with another part in this position, and therefore, it will not be deformed.

Figure 7:
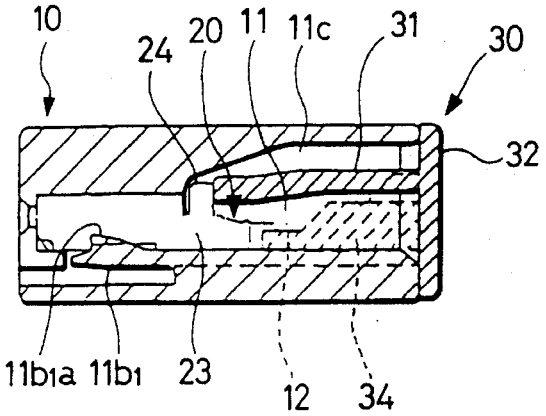
FIG. 7 is a cross-sectional view of the connector in a completely-locked condition.
Figure 8:
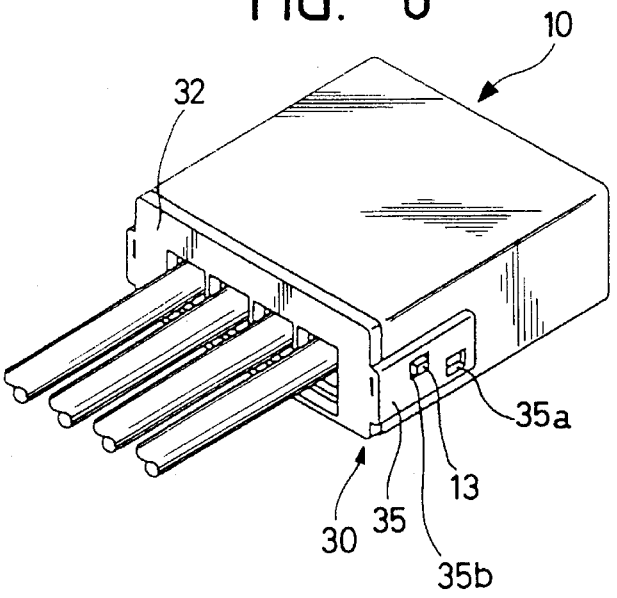
FIG. 8 is a perspective view of the connector in the completely-locked condition.
Figure 9:
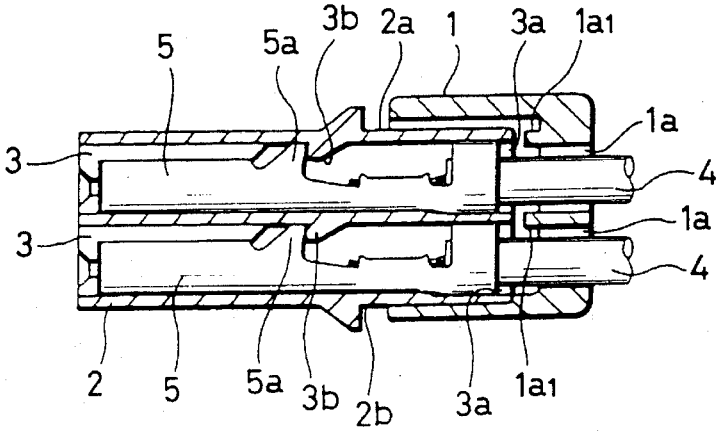
FIG. 9 (RELATED ART)
FIG. 9 is a cross-sectional view of a conventional connector in a provisionally-locked condition.
Figure 10:
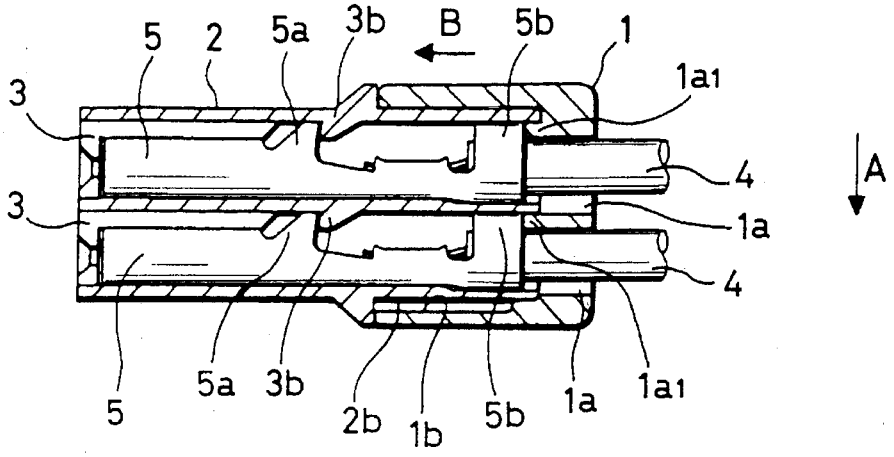
FIG. 10 (RELATED ART)
FIG. 10 is a cross-sectional view of the conventional connector in a completely-locked condition.
Figure 11:
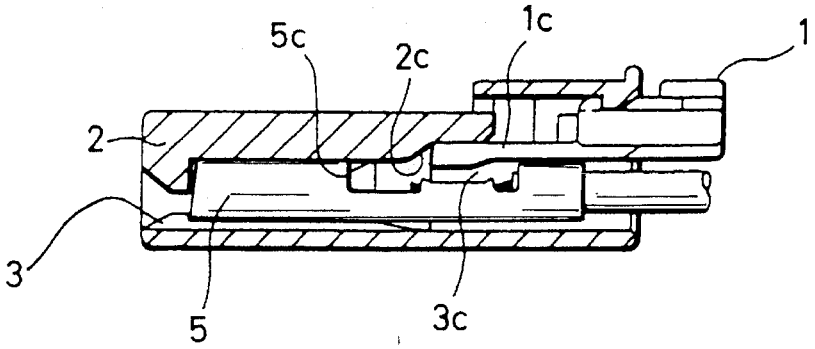
FIG. 11 (RELATED ART)
FIG. 11 is a cross-sectional view of another conventional connector in a provisionally-locked condition.
Figure 12:
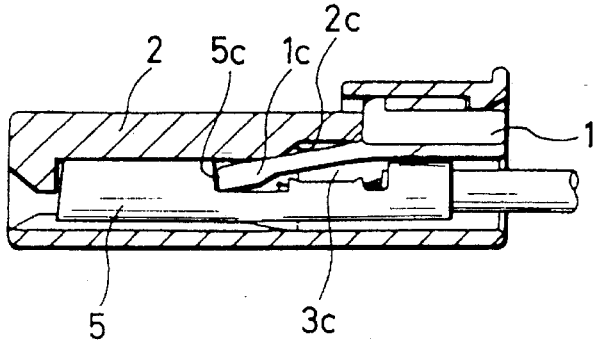
FIG. 12 (RELATED ART)
FIG. 12 is a cross-sectional view of the FIG. 11 conventional connector in a completely-locked condition.

After the metal terminal 20 is inserted, the retainer 30 is pushed in a direction indicated by arrow C (FIG. 6). As a result, the engagement between the engagement hole 35*a* of the engagement piece 35 and the projection 13 of the housing 10 is forcibly released, and the slanting surface 34*b* of the guide piece 34 of the retainer 30 is brought into sliding contact with the slanting surface $12b_2$ of the guide hole 12 of the housing 10, and the upper corner of the front end of the guide piece 34 is brought into sliding contact with the slanting surface $12b_1$ of the guide hole 12. In this condition, the retainer 30 begins to move obliquely downward in a parallel direction. Then, when the overlapping surface engagement between the slanting surface 34*b* and the slanting surface $12b_2$ is lost, the retainer 30 moves straight a distance equal to the length of the horizontal wall surface $12a_2$ of the housing 10, and the slanting surface 34*b* of the retainer 30 abuts against the slanting surface $12b_1$ of the housing 10, so that the retainer is stopped, as shown in FIGS. 7 and 8. At this time, the front face of the body 32 of the retainer 30 is abutted against the rear face of the housing 10, and the projections 13 of the housing 10 are engaged respectively in the engagement holes 35*b* in the engagement pieces 35, thereby achieving the complete lock.

With this movement, the retaining piece 31 first moves obliquely downwardly at the stand-by portion 11*c* to approach the metal terminal 20, so that the retaining piece 31 is disposed in registry with the terminal retaining portion 24 of the metal terminal 24 in a horizontal direction. The retaining piece 31, after being moved obliquely downwardly, is advanced so that the front end of the retaining piece 31 abuts against the rear edge of the upper portion of the terminal retaining portion 24. As a result, a second withdrawal preventing connection is achieved. In this embodiment, in order to ensure that the projection 13 on the housing 10 can be smoothly moved from the engagement hole 35*a* of the engagement piece 35 into the engagement hole 35*b*, a groove 35C extending from the engagement hole 35*a* to the engagement hole 35*b* is formed in the inner surface of the engagement piece 35.

During insertion of the metal terminal 20, if it fails to be pushed into the proper position, because the retaining piece 31 advances straight from the rear side of the terminal retaining portion 24 to abut against this terminal retaining portion 24, as described above, the retaining piece 31 guides terminal 20 fully into position, thereby effecting the first withdrawal preventing connection in the proper position. Furthermore, the retaining piece advances straight by the predetermined distance from the rear side, and therefore it can be pushed in more accurately, as compared with the type of retaining piece adapted to be pressed in an oblique direction.

When the retaining piece 31 is held against the rear end of the terminal retaining portion 24, the retaining piece 31 is not flexed in a vertical direction and retains an initial posture relative to the body 32. Therefore, when the retainer 30 is returned to the provisionally-locked position because of maintenance, the retaining piece 31 is retained close to the upper wall surface in the stand-by portion 11*c* of the terminal receiving chamber 11, and therefore will not obstruct the withdrawal of the metal terminal 20.

In this embodiment, although in the provisionally-locked position, the retaining piece 31 is retained in the terminal receiving chamber 11, the retaining piece may face the upper edge of the rear open end of the terminal receiving chamber 11. In this case, during the time when the retaining piece moves obliquely by the cooperation of the guide pieces with the guide holes, the retaining piece enters the terminal receiving chamber 11 to abut against the rear end of the insulation barrel of the metal terminal.

While the invention has been described with reference to the structure disclosed, it is not confined to the details set forth, but is intended to cover such modifications or changes as may come within the scope of the following claims.

What is claimed is:

1. A connector comprising a housing having a terminal receiving chamber for holding a metal terminal therein and a terminal retainer for preventing withdrawal of said metal terminal in a completely-locked position where said terminal retainer is held generally in contact with a rear end of said housing, said terminal retainer allowing detachment and attachment of said metal terminal in a provisionally-locked position where said terminal retainer is disposed rearwardly of said rear end and is spaced radially from a longitudinal axis of said metal terminal, where the connector further comprises means for guiding said terminal retainer to move diagonally with respect to said longitudinal axis from the provisionally-locked position to the completely-locked position such that said rear end becomes aligned with said longitudinal axis when said terminal retainer is pushed into said housing by a force applied in a direction normal to said terminal retainer.

2. A connector according to claim 1, wherein said terminal retainer has a retaining piece projecting along a direction of insertion of said metal terminal, said terminal receiving chamber having a stand-by portion means for allowing said retaining piece to move toward the axis of said metal terminal to prevent withdrawal of said metal terminal, said stand-by portion means also for allowing, in the provisionally-locked condition, said retaining piece to stand-by at a position spaced from the axis of said metal terminal to prevent the attachment and detachment of said metal terminal from being obstructed.

3. A connector according to claim 1, wherein said guiding means comprises at least one guide hole and at least one guide piece, said at least one guide hole and said at least one guide piece being shaped to guide said metal terminal from said provisionally-locked position to said completely-locked position when said retainer is pushed into said housing.

4. A connector according to claim 3, wherein said at least one guide piece comprises an inclined step shape having an inclined step, said inclined step including a first upper horizontal surface, a first inclined surface, and a first lower horizontal surface, and said at least one guide hole comprises a reverse inclined step shape having a first reverse inclined step and a second reverse inclined step, said first reverse inclined step including a second upper horizontal surface, a second inclined surface, and an intermediate horizontal surface, said second reverse inclined step including said intermediate horizontal surface, a third inclined surface, and a third lower horizontal surface, said inclined step of said guide piece being engagable with said first and second reverse inclined steps, wherein said inclined step of said guide piece engages said first reverse inclined step in said provisionally-locked position such that said first upper horizontal surface faces said second upper horizontal surface, said first inclined surface faces said second inclined surface, and said first lower horizontal surface faces said intermediate horizontal surface, and said inclined step of said guide piece engages said second reverse inclined step in said completely-locked position such that said first upper horizontal surface faces said intermediate horizontal surface, said first inclined surface faces said third inclined surface, and said first lower horizontal surface faces said third lower horizontal surface.

5. A connector according to claim 3, wherein said guiding means further comprises at least one engagement piece having a first engagement aperture corresponding to said provisionally-locked position and a second engagement aperture corresponding to said completely-locked position, wherein said housing further comprises at least one projection engagable with said first and second engagement apertures.

6. A connector according to claim 5, wherein said guiding means further comprises a groove between said first engagement aperture and said second engagement aperture, said groove guiding said projection from said first engagement aperture to said second engagement aperture.

7. A connector comprising:

a housing having at least one terminal receiving chamber and at least one guide hole;

a retainer having a least one retaining piece and at least one guide piece corresponding to said at least one terminal receiving chamber and said at least one guide hole, respectively, and at least one insertion hole corresponding to said at least one terminal receiving chamber; and a metal terminal having at least one contact portion and a corresponding at least one insulation barrel clamping a sheath of an electric wire, said at least one contact portion being insertable through said at least one insertion hole and said at least one terminal receiving chamber, wherein said metal terminal is movable from a provisionally-locked position, wherein said metal terminal is attached and detached to said retainer, to a completely-locked position, wherein said metal terminal is prevented from being detached from said retainer, said at least one guide hole and said at least one guide piece being shaped to guide said metal terminal from said provisionally-locked position diagonally with respect to said longitudinal axis to said completely-locked position when said retainer is pushed into said housing.

8. A connector according to claim 7, wherein said at least one guide piece comprises an inclined step shape having an inclined step, said inclined step having a first upper horizontal surface, a first inclined surface, and a first lower horizontal surface, and said at least one guide hole comprises a reverse inclined step shape having a first reverse inclined step and a second reverse inclined step, said first reverse inclined step including a second upper horizontal surface, a second inclined surface, and an intermediate horizontal surface, said second reverse inclined step including said intermediate horizontal surface, a third inclined surface, and a third lower horizontal surface, said inclined step of said guide piece being engagable with said first and second reverse inclined steps, wherein said inclined step of said guide piece engages said first reverse inclined step in said provisionally-locked position such that said first upper horizontal surface faces said second upper horizontal surface, said first inclined surface faces said second inclined surface, and said first lower horizontal surface faces said intermediate horizontal surface, and said inclined step of said guide piece engages said second reverse inclined step in said completely-locked position such that said first upper horizontal surface faces said intermediate horizontal surface, said first inclined surface faces said third inclined surface, and said first lower horizontal surface faces said third lower horizontal surface.

9. A connector according to claim 7, further comprising at least one engagement piece having a first engagement aperture corresponding to said provisionally-locked position and a second engagement aperture corresponding to said completely-locked position, wherein said housing further comprises at least one projection engagable with said first and second engagement apertures.

10. A connector according to claim 9, further comprising a groove between said first engagement aperture and said second engagement aperture, said groove guiding said projection from said first engagement aperture to said second engagement aperture.

* * * * *